United States Patent [19]

Hixson

[11] Patent Number: 4,561,589

[45] Date of Patent: Dec. 31, 1985

[54] RAIL FASTENING ASSEMBLY

[76] Inventor: Richard M. Hixson, 4140 Thunderbird Dr., Marietta, Ga. 30067

[21] Appl. No.: 497,606

[22] Filed: May 24, 1983

[51] Int. Cl.[4] ..... E01B 9/42; E01B 9/48

[52] U.S. Cl. ..... 238/297; 238/310

[58] Field of Search ..... 238/264, 265, 287, 297, 238/308, 309, 310, 291

[56] References Cited

U.S. PATENT DOCUMENTS

| | | | |
|---|---|---|---|
| 3,494,554 | 2/1970 | Hall | 238/310 |
| 3,519,205 | 7/1970 | Monclin et al. | 238/338 |
| 3,576,293 | 4/1971 | Landis et al. | 238/310 X |
| 3,616,999 | 11/1971 | Ruble | 238/315 |
| 3,784,097 | 1/1974 | Landis | 238/310 |
| 3,858,804 | 1/1975 | Hixson | 238/310 X |
| 3,904,113 | 9/1975 | Molyneux | 238/310 X |
| 4,062,490 | 12/1977 | Hixson | 238/310 X |
| 4,111,361 | 9/1978 | Sonneville | 238/338 |
| 4,150,791 | 4/1979 | Reynolds et al. | 238/310 X |
| 4,238,138 | 12/1980 | Demorieux | 238/338 X |
| 4,307,837 | 12/1981 | Leingang | 238/310 X |
| 4,312,477 | 1/1982 | Hixson | 238/310 X |

*Primary Examiner*—Robert B. Reeves
*Assistant Examiner*—David F. Hubbuch
*Attorney, Agent, or Firm*—Sutherland, Asbill & Brennan

[57] ABSTRACT

The assembly is made up of four components. First is a rectangular, steel base plate designed to lie between the rail and the tie structure. The plate has a hole near each end. The second component is a clip that holds the rail to the base plate. The third and fourth components are a pair of anchoring devices, one for each end of the base plate. Each anchoring device has three parts. The first part is a steel base member having a first end that is nearest to the rail, a second end that is opposite the first end and extends at least to the adjacent end of the base plate, and a middle section joining the first and second ends. A flange-headed hook projects upwardly from the first end of the base member. The first end of the base member fits in the hole in the base plate so as to interlock the base plate with the anchoring device, like two pieces of a jigsaw puzzle. The flanged head of the hook overlaps part of the base plate, so as to hold it down. Finally, a fastener, such as a bolt, fastens the second end of the base member to the railroad tie, restraining the base plate from any lateral or vertical movement.

10 Claims, 15 Drawing Figures

13
28
17
29
20
30
19
17
20
21
19
14
10
28
10
14
11
18
16
16
30
29
11

RAIL FASTENING ASSEMBLY

This invention relates to a combination of parts for holding a steel transportation rail to a tie structure, i.e., a rail fastening assembly.

Steel transportation rails are routinely held to underlying tie structures by a combination of parts that are supplied in unassembled form, referred to herein as a rail fastening assembly. The performance objectives of such rail fastening assemblies include the ability to hold the rail securely and to dampen vibration (and so provide a smoother, quieter ride and longer life for the tie structure), ease of installation, good adjustability, and resistance to breaking or working loose after installation. In addition, of course, the assembly should be economical to manufacture. I have designed a rail fastening assembly that possesses an excellent combination of those features.

The rail fastening assembly of my invention is comprised of (a) a generally rectangular, steel base plate designed to lie between the rail and the tie structure in a substantially perpendicular direction to the rail, the plate having a vertical hole therethrough near each end of the plate, the hole being designed to receive the hook member described below;

(b) means for releasably holding the rail to the base plate in a fixed position intermediate the ends of the plate; and (c) a pair of anchoring devices, one for each end of the base plate, each of the devices being comprised of (i) a steel base member having a first end that is designed to be positioned nearest to the rail, a second end that is opposite the first end and is designed to extend at least to the adjacent end of the base plate, and a middle section joining the first and second ends; (ii) a flange-headed hook member that projects upwardly from, and is integral with, the first end of the base member, the hook member being designed to protrude through the vertical hole in the base plate so as to interlock the base plate with the anchoring device, the flanged head of the hook member being designed to overlap part of the base plate adjacent the hole; and (iii) means associated with the second end of the base member for fastening the base member to the structure, thereby restraining the base plate from lateral and vertical movement with respect to the tie structure. Other elements may also be included in the assembly, but the parts just described constitute its basic components.

As stated above, the steel base plate in the assembly of the present invention contains a hole near each end, through which it interlocks with an anchoring device that is fastened to the tie structure. Preferably, the hole is connected via a narrower, throat-like opening in the plate to the edge of the adjacent end of the plate, and the configuration of the hole and throat-like opening substantially matches the outline of the first end and middle section of the base member of the anchoring device. In other words, the base plate and the base member preferably fit together like pieces of a jigsaw puzzle. In this manner the anchoring device can be interlocked with the base plate by first positioning the base plate on the tie structure, and then lowering the base member of the anchoring device into position inside the hole in the base plate. Then, after the anchoring device is fastened to the tie structure, the base plate will be restrained from lateral movement due to being interlocked with the base member, and the plate will be held down against the tie by the overlapping flange on the hook portion of the base member.

Numerous different configurations of the complementary pieces in the jigsaw puzzle-type interlock can be used. For example, the first end of the base member can be rectangular and the middle section can be rectilinear also. Alternatively, the outline of the first end and middle section, or of the middle section alone, can be trapezoidal, with the base of the trapezoid lying towards the rail, to provide a dovetail joint similar to that sometimes used by cabinetmakers in the construction of wooden drawers. Still another alternative is a keyhole shape.

As stated above, the flange on top of the hook member overlaps at least a portion of the surrounding base plate, to hold the plate down. The flange may extend in various directions from the hook member, depending on the direction and extent of the lifting forces acting on the rail at that particular point. Generally speaking, the stronger the lifting force that needs to be restrained, the larger the surface area of the flange that should be used, also the greater the circumference of the hook-receiving hole that should be overlapped by the flange. Often it will be preferred that the flange overlap at least about 50 percent (50%) of the circumference of the hook-receiving hole.

The particular means for holding the rail to the base plate are not critical to the apparatus of the present invention. The holding means should be releasable, however, and should serve to keep the rail in a fixed position against the plate. The holding means may be adjustable, if desired, to allow the rail to be shifted sideways on the base plate. Often it will instead be preferred, however, to provide adjustability where the base member of the anchoring device is fastened to the tie structure, as will be discussed below. Some examples of suitable rail holding means for use in my assembly are spring rail clamps such as disclosed in U.S. Pat. Nos. 4,150,791 and 4,307,837 and rail supporting clips such as disclosed in U.S. Pat. Nos. 3,576,293 and 3,858,804. Those types of holding means are releasably fastened to the base plate and have an overhanging portion that presses down on the flanged foot of a steel transportation rail, holding the rail firmly to the base plate.

As stated above, one end of the anchoring device base member in the assembly of the present invention rises in a hook member that is designed to fit in the hole in the base plate, while the opposite end is associated with means for fastening the base member to the tie structure. Many different fastening means can be used. For example, if it is not required to allow for lateral adjustment between the base plate and the tie structure, the base member can simply be bolted to the tie structure through one or more round holes near the second (or outside) end of the base member. But if adjustability of the base plate is desired, that can be accomplished by using (a) a slotted hole through the second end of the base member, enabling the base member to be adjustably held to the tie by an anchor bolt, and (b) a washer member that is designed to be mounted snugly on the anchor bolt and ride next to the base member to hold the base member in one place when the washer member is tightened against it, both the base member and the washer member having complementary serrated surfaces that adjustably intermesh to help prevent the base member from sliding past the washer member when the washer member is tightened against it. In this last arrangement the axis of the slotted hole runs substantially perpendicular to the transportation rail, so as to permit lateral adjustment of the rail. A suitable example of fastening means of this type may be found in U.S. Pat. No. 3,858,804 (see FIGS. 3-11 thereof).

In order to dampen vibration, the assembly of the present invention may additionally include an elastomeric pad designed to underlie the base plate. In certain applications it may be preferred to bond the pad to the plate. It may also be preferred in some circumstances to use a second steel plate, parallel to the first, and to sandwich the elastomeric pad between the two plates.

The types of elastomer that can be used to cushion rail fastening assemblies are well known in the art and include, for example, natural rubber and neoprene.

The assembly of the present invention may also include means for electrically isolating the base plate from the anchoring device. Dielectric inserts, sleeves, or bushings can be used for that purpose. Preferably they will be made of a substantially non-resilient material, such as molded nylon.

My rail fastening assembly can be used with any type of tie structure—timber, concrete, or metal.

My invention will be better understood by reviewing the drawings accompanying this specification, which depict three different embodiments of the invention. Referring to those drawings:

FIG. 1 is a top view of the first embodiment.

FIG. 2 is an enlarged front view (taken along the line 2—2 in FIG. 1) of the anchoring device portion of the assembly shown in FIG. 1.

FIG. 3 is a right side view of the anchoring device portion, taken along the line 3—3 in FIG. 2.

FIG. 4 is an enlarged front view (taken along the line 4—4 in FIG. 1) of the rail holding means of the assembly shown in FIG. 1.

FIG. 5 is an enlarged, exploded, isometric view of the principal parts of the anchoring means of the assembly shown in FIG. 1.

FIG. 6 is an enlarged, assembled, isometric view of the first embodiment, with the anchor bolts omitted for the sake of clarity.

FIG. 7 is a top view of the second embodiment.

FIG. 8 is an enlarged front view (taken along the line 8—8 in FIG. 7) of the rail holding assembly shown in FIG. 7.

FIG. 9 is an enlarged, exploded, isometric view of the principal parts of the anchoring means of the assembly shown in FIG. 7.

FIG. 10 is an enlarged, assembled, isometric view of the second embodiment, with the anchor bolts omitted for the sake of clarity.

FIG. 11 is a top view of the third embodiment.

FIG. 12 is an enlarged front view (taken along the line 12—12 in FIG. 11) of the anchoring device portion of the assembly shown in FIG. 11.

FIG. 13 is an enlarged front view (taken along the line 13—13 in FIG. 11) of the rail holding means of the assembly shown in FIG. 11.

FIG. 14 is an enlarged, exploded, isometric view of the principal parts of the anchoring means of the assembly shown in FIG. 11.

FIG. 15 is an enlarged, assembled, isometric view of the third embodiment, with the anchor bolts omitted for the sake of clarity.

Figure 1:
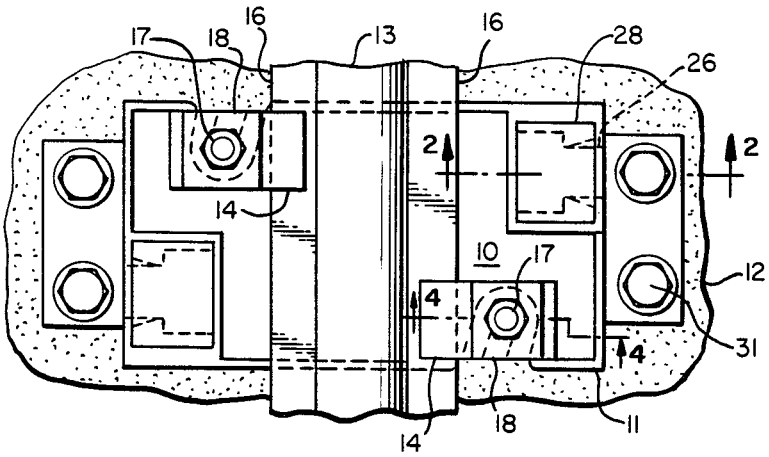
FIGS. 1-6 depict a first embodiment of the rail fastening assembly of the present invention.
Figure 2:
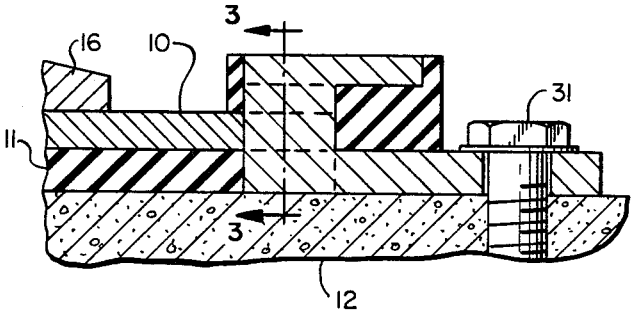
Figure 3:
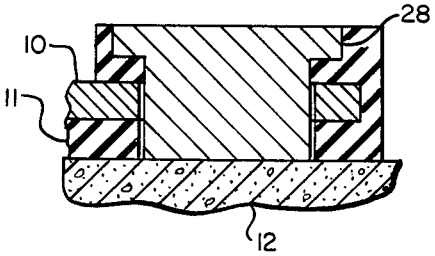
Figure 4:
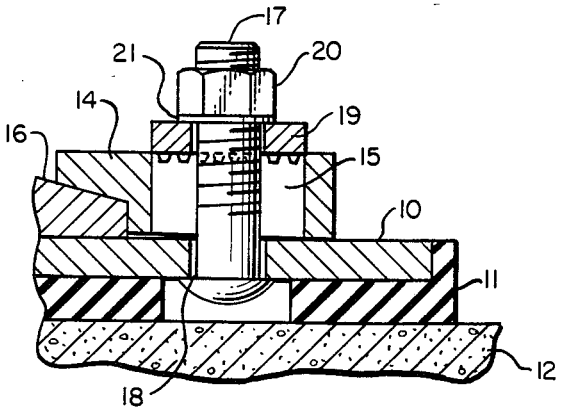
Figure 5:
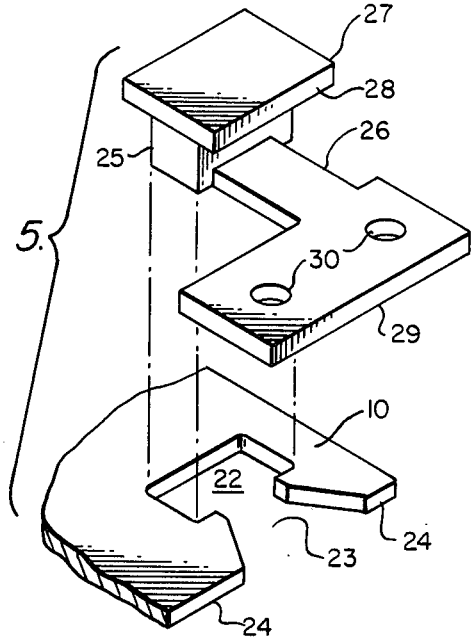
Figure 6:
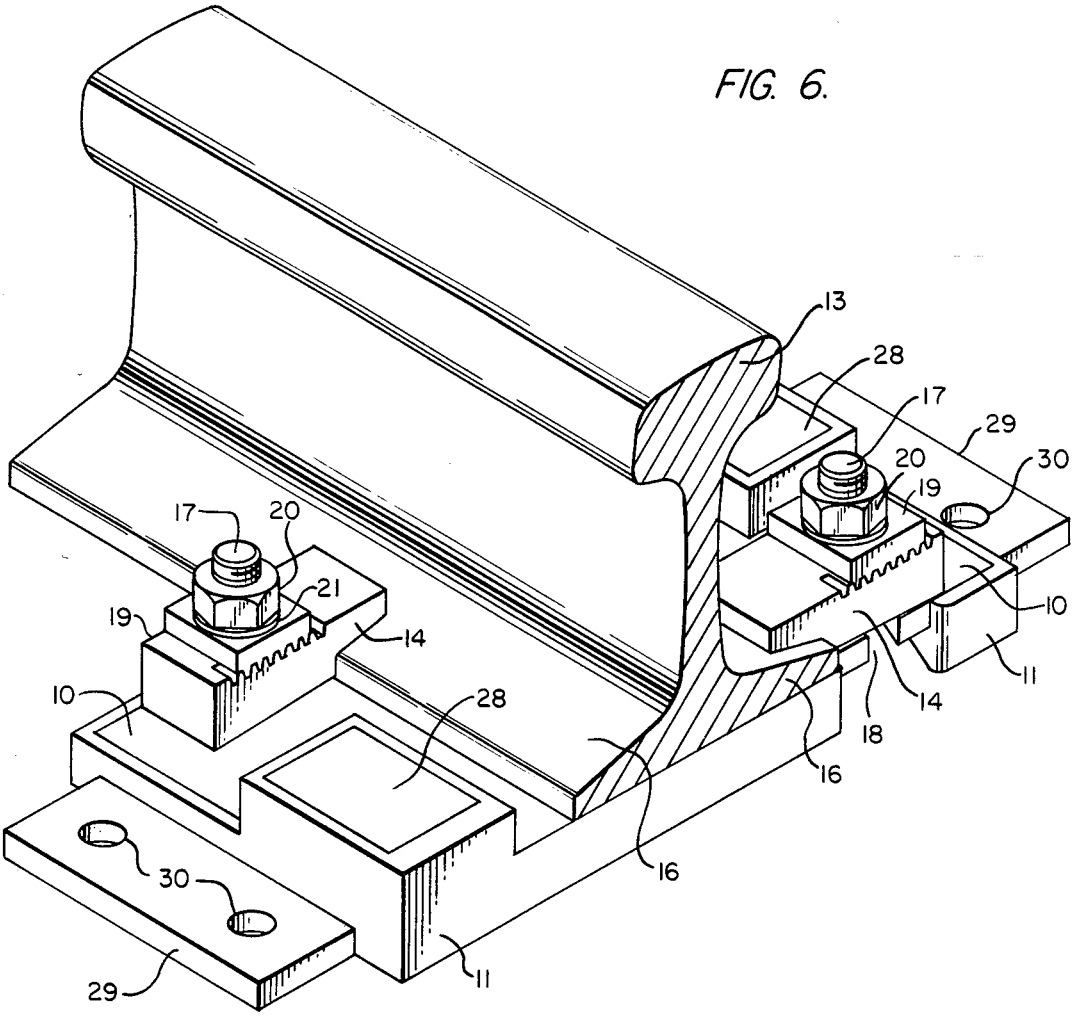
Figure 7:
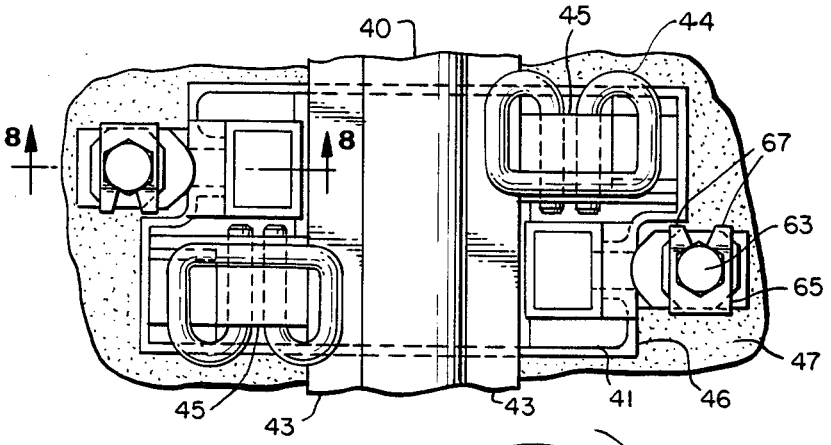
FIGS. 7-10 depict an alternative embodiment of the rail fastening assembly of the present invention.

In the first embodiment, shown in FIGS. 1-6, a generally rectangular steel base plate 10 fits snugly inside elastomeric tray 11, which sits on concrete tie structure 12. Steel transportation rail 13 rests on top of plate 10 at its midpoint. Each foot 16 of rail 13 is held tightly against plate 10 by clip 14 which has a slotted center hole 15. Carriage bolt 17 projects upwardly through slotted opening 18 in the edge of plate 10. Large washer 19, which has a serrated undersurface and a round center hole, fits snugly on bolt 17 and rides against the serrated top surface of clip 14. The serrations on the undersurface of large washer 19 mate with those on the top surface of clip 14. Rail 13 and clip 14 can be shifted either to the right or to the left when large washer 19 is raised up. Once rail 13 is in the desired position, nut 20 and small washer 21 are tightened down on top of large washer 19 to hold rail 13 in a fixed position against base plate 10.

Near each end of base plate 10 is a vertical hole 22 which has a rectangular configuration. Hole 22 is connected via throat-like opening 23 to the edge of the adjacent end 24 of plate 10.

Resting inside hole 22 and connecting opening 23 is the first end 25 and middle section 26 of steel base member 27. The outline of first end 25 and middle section 26 substantially matches the configuration of hole 22 and throat-like opening 23, so that base member 27 interlocks with base plate 10.

First end 25 of base member 27 rises in a hook member which terminates in a flanged head 28. Flange 28 extends to two sides and the rear of base member 27, thereby overlapping base plate 10 along three of the four sides of hook-receiving hole 22.

To dampen the vibration set up in base plate 10 when a train rolls over rail 13, before that vibration reaches tie structure 12, elastomer pad 11 wraps around the vertical edge of plate 10 and is sandwiched between the undersurface of flange 28 and the top surface of plate 10. The bottom of base member 27 rests directly on tie structure 12.

The second end 29 of base member 27 is provided with a pair of round holes 30, through which bolts 31 pass. The threaded ends of bolts 31 are held in place by female theaded anchor members (not shown) that are cast in place in concrete tie structure 12.

In the embodiment of my invention shown in FIGS. 7-10, rail 40 rests on generally rectangular base plate 41, between ridges 42 which serve to center the rail on the plate. Each foot 43 of rail 40 is held tightly against plate 41 by spring clip 44, the ends of which are driven under a raised cut-out 45 of plate 41 by blows from a sledge hammer (not shown). Plate 41 sits in elastomeric tray 46, which rests on concrete tie structure 47.

Near each end of plate 41 is a rectangular hole 48, which is connected via a narrower, throat-like opening 49 to the edge of the end 50 of the plate. The configuration of hole 48 and opening 49 substantially matches the outline of the first end 51 and middle section 52 of base member 53, so that the two parts interlock when base member 53 is lowered into place. To provide electrical insulation between plate 41 and base member 53, molded nylon isolator sleeve 54 is positioned between the two steel parts. The first end 51 of base member 53 rises in a hook member that ends in a flanged head 55.

Flange 55 overlaps one long edge 56 of hole 48, thereby holding down plate 41.

The second end 57 of base member 53 has a slotted hole 58 in it which is bordered by two rows of serrations 59 and 60. Serrations 59 are opposite in phase to serrations 60. Washer member 61 has serrations 62 on its undersurface which mate with serrations 59 and 60 on base member 53. Washer member 61 is held tightly against base member 53 by bolt 63, which screws into steel anchor 64 in tie structure 47. Because the hole 58 is elongated, base member 53 can be shifted laterally with respect to rail 40. Because of the staggered phases of serrations 59 and 60, it is possible to make a lateral adjustment of base member 53 of only one-half the distance between the center lines of adjacent teeth in the serrations. This is done by lifting and rotating washer member 61 180 degrees, sliding interlocked base member 53 and base plate 41 the desired distance, and then lowering washer member 61 back into place.

To help prevent bolt 63 from backing out of anchor 64, lock washer 65 is provided. Lock washer 65 has a down-turned edge 66 that abuts one of the flats on washer member 61, preventing lock washer 65 from turning. The opposite side of washer 65 ends in two tabs 67 that are designed to be bent up against adjacent flats on the head of bolt 63, to prevent the bolt from turning.

Figure 8:
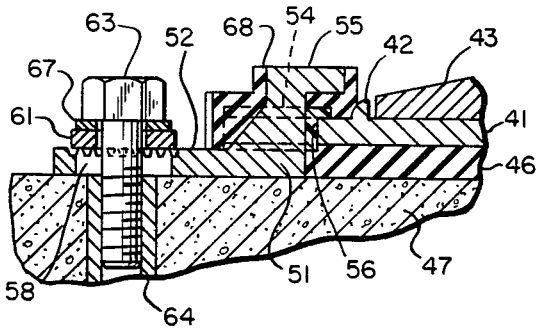
Figure 9:
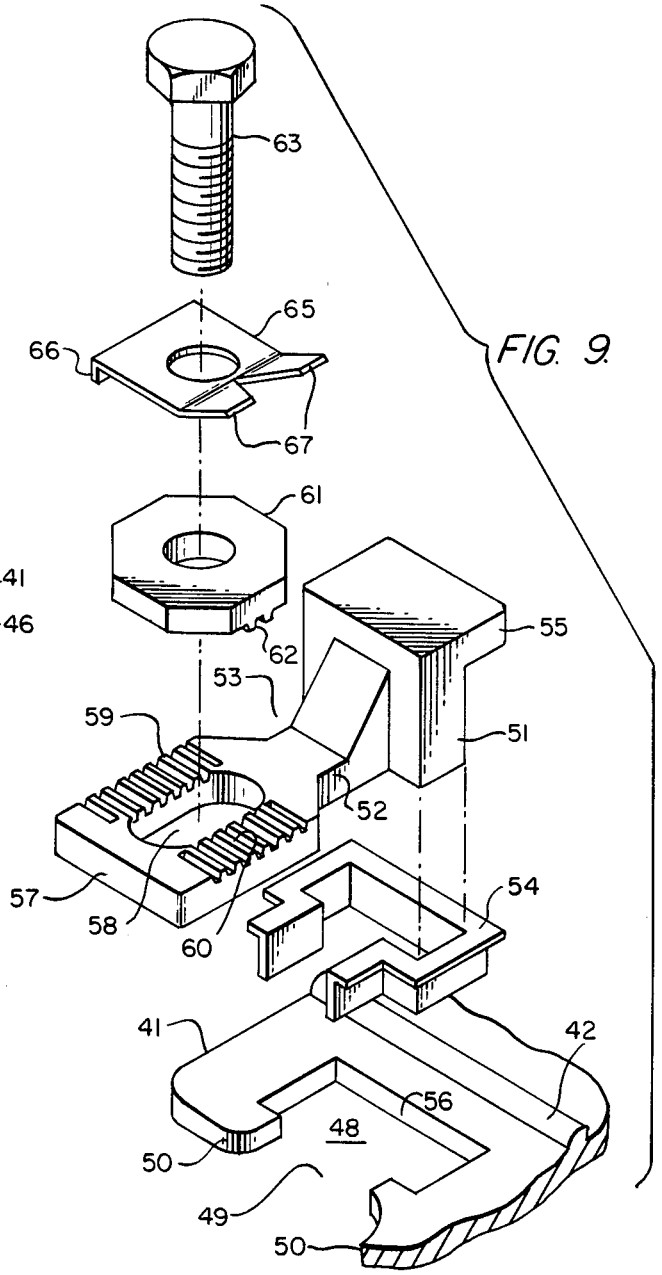
Figure 10:
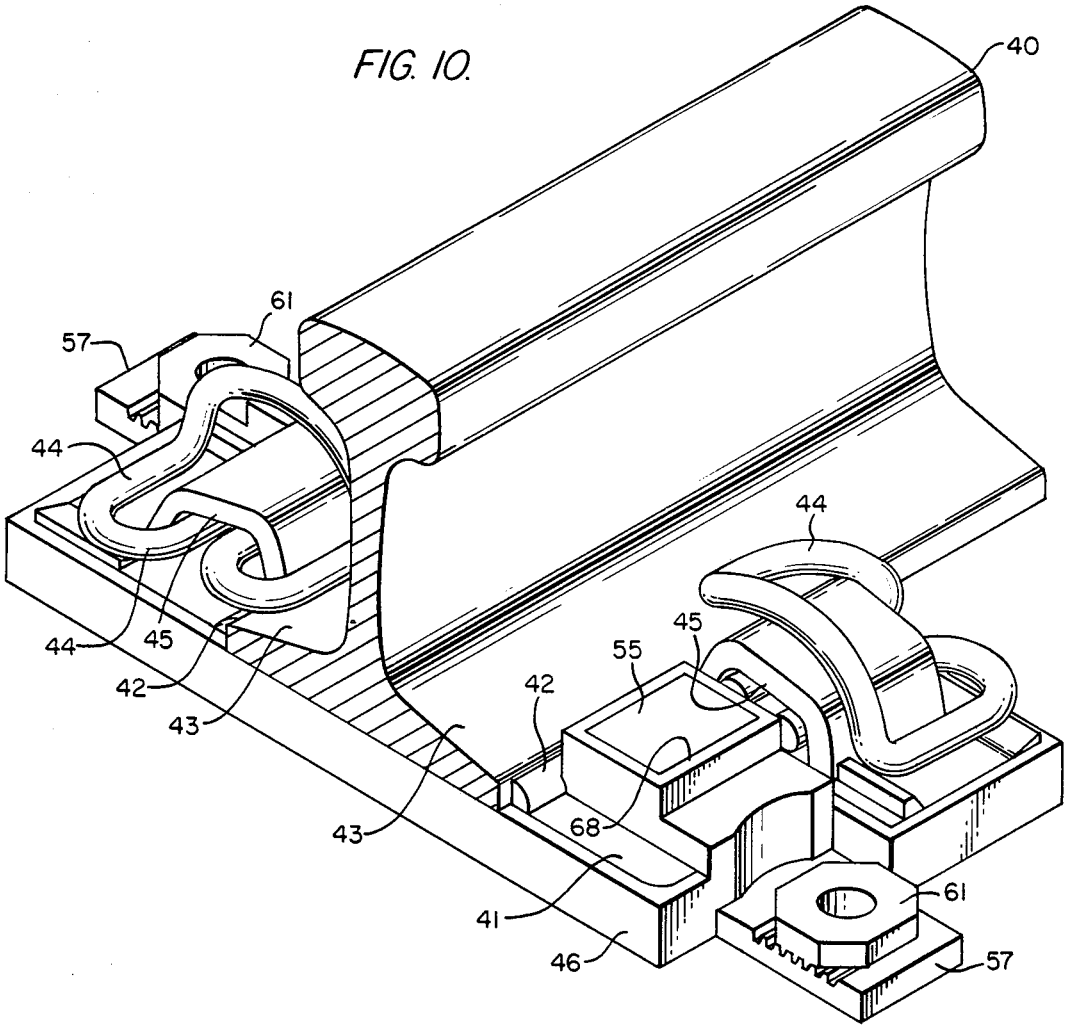
Figure 11:
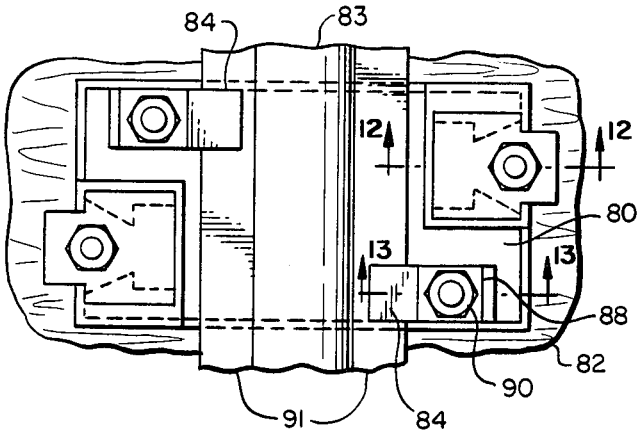
FIGS. 11-15 depict a third embodiment of the fastening assembly of the present invention.
Figure 12:
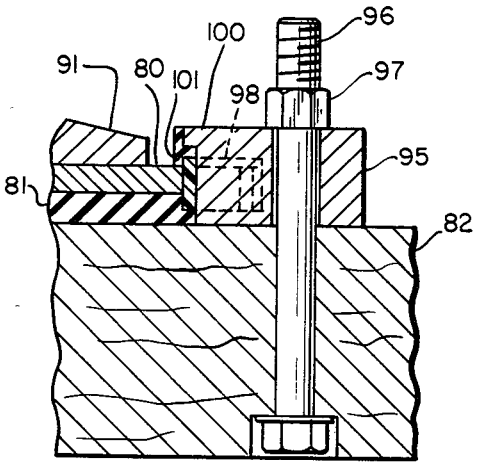
Figure 14:
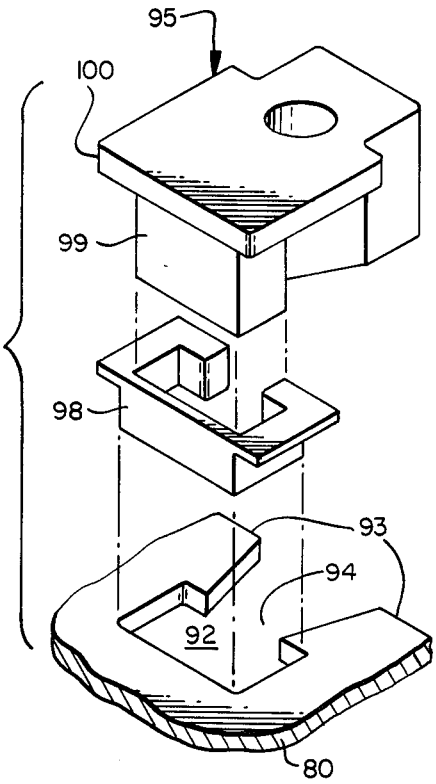
Figure 13:
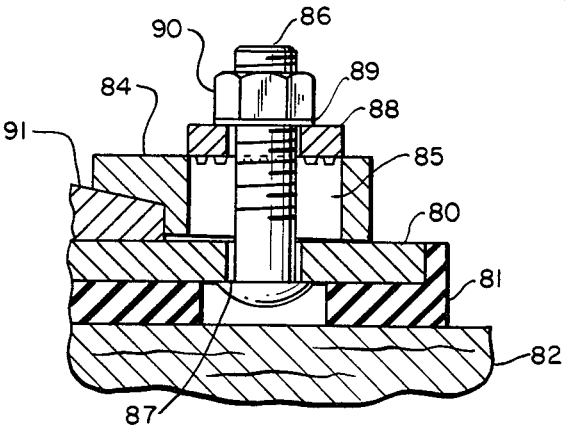
Figure 15:
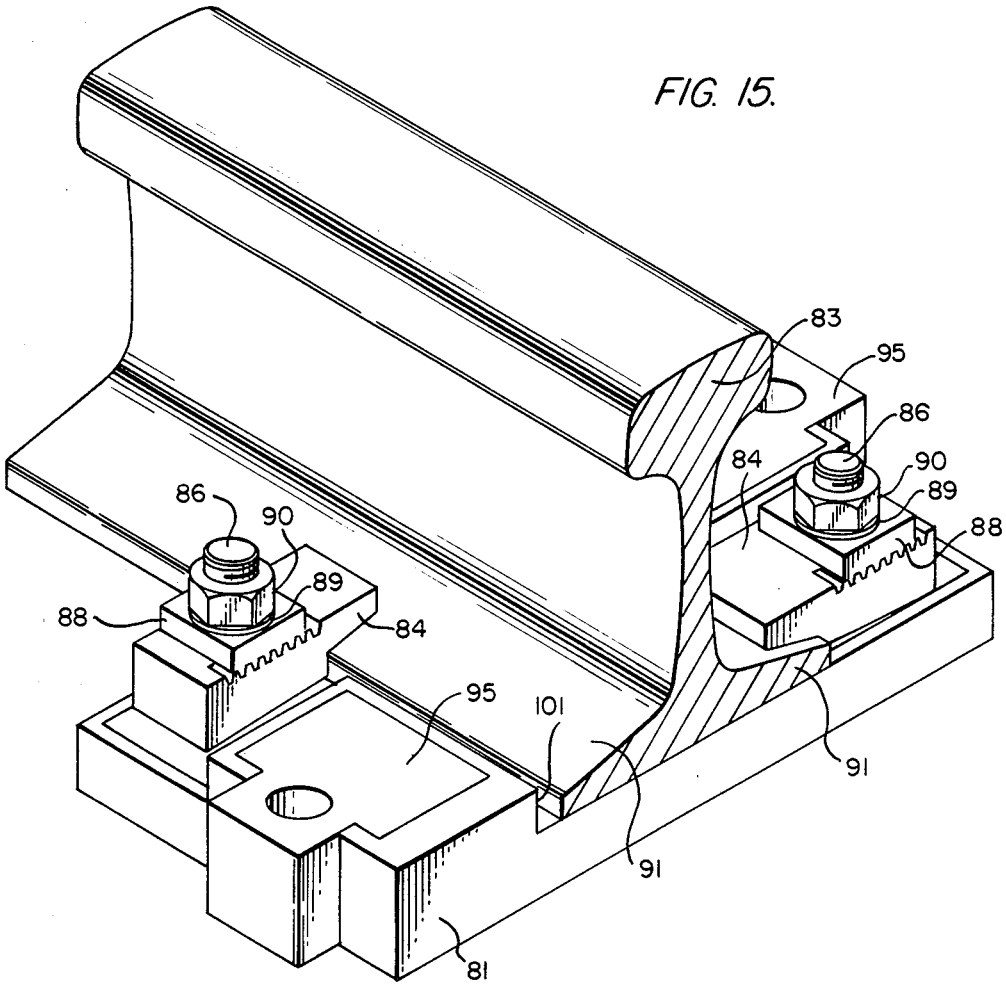

As best seen in FIG. 8, the first end 51 and part of the middle section 52 of base member 53 are encased in an elastomer 68. This is especially desirable where electrical isolation is necessary between the rail and the anchoring devices. The encasement can be accomplished by placing a mold around flanged head 55 of base member 53 and pouring into the mold a mixture of an elastomeric latex and a curing agent that will cause the mixture to solidify. Encapsulation in this manner seals the cracks and voids around the steel parts, which might otherwise collect dirt and debris that could lead to an electrical path between base plate 41 and base member 53.

In the embodiment of my invention shown in FIGS. 11–15, a generally rectangular, steel base plate 80 rests in elastomeric tray 81, which sits on top of timber tie 82. Rail 83 is held on top of plate 80 by clip members 84, which ride on top of feet 91 of the rail. Clip member 84 is provided with a slotted center hole 85 for adjustability. Clip member 84 is held to base plate 80 by carriage bolt 86 (which protrudes upwardly through a round hole 87 in plate 80), rectangular washer 88, round washer 89, and nut 90. The undersurface of rectangular washer 88 is serrated, to match the complementary serrations on the top surface of clip member 84.

Near each end of base plate 80 is provided a rectangular, vertical hole 92, which is connected to the end 93 of the plate by a narrower, throat-like opening 94. Plate 80 is held down by steel retaining member 95, which is fastened to tie 82 by bolt 96 and lock nut 97. The outline of the base of retaining member 95 substantially matches the configuration of hole 92 and opening 94, so that retaining member 95 fits inside the hole and opening. A molded nylon isolator sleeve 98 fits over the first end 99 of retaining member 95, to provide electrical isolation between plate 80 and retaining member 95. First end 99 of member 95 is capped by a flange 100 that extends substantially all around the circumference of hole 92. To preserve the electrical isolation between base plate 81 and retaining member 95, the retaining member is encased in an elastomer 101 that is formed in place by use of a mold and a curable latex, in the same manner as described for the assembly depicted in FIGS. 7–10.

I claim:

1. A rail fastening assembly for holding a steel transportation rail to a tie structure, said assembly comprising:

(a) a generally rectangular, steel base plate designed to lie between the rail and the tie structure in a substantially perpendicular direction to the rail, said plate having a vertical hole therethrough near each end of the plate, said hole being designed to receive a flange-headed hook member and being connected via a narrower throat-like opening in the plate to the edge of the adjacent end of the plate;

(b) means for releasably holding the rail to the base plate in a fixed position intermediate the ends of the plate; and (c) a pair of anchoring devices, one for each end of the base plate, each said device being comprised of (i) a steel base member having a first end that is designed to be positioned nearest to the rail, a second end that is opposite the first end and is designed to extend at least to the adjacent end of the base plate, and a middle section joining the first and second ends, the outline of the first end and middle section being substantially the same configuration, but slightly smaller, as the hole and throat-like opening in the steel base plate, respectively, so that said first end of the base member can be lowered into said hole in the base plate in interlocking engagement therewith; (ii) said flange-headed hook member projecting upwardly from, and being integral with, the first end of the base member, the flanged head of said hook member being designed to overlap part of the base plate adjacent said hole; and (iii) means associated with the second end of the base member for fastening said base member to the tie structure, thereby restraining the base plate from lateral and vertical movement with respect to the tie structure.

2. The assembly of claim 1 further comprising dielectric means for electrically isolating the base plate from the anchoring devices.

3. The assembly of claim 2 wherein the means for fastening the base member of the anchoring device to the rail tie include a slotted, vertical hole through the second end of the base member that enables the base member to be adjustably held to the tie by an anchor bolt, the direction of the slot being substantially perpendicular to the rail, and a washer member that is designed to be mounted snugly on the anchor bolt and ride next to the base member to hold the base member in one place when the washer member is tightened against it, both the base member and the washer member having complementary serrated surfaces that adjustably intermesh to help prevent the base member from sliding past the washer member when the washer member is tightened against it.

4. The assembly of claim 1 wherein the flanged head of the hook member of the anchoring device is designed to overlap at least about 50 percent of the circumference of the hook-receiving hole.

5. The assembly of claim 4 wherein the means for fastening the base member of the anchoring device to the rail tie include a slotted, vertical hole through the second end of the base member that enables the base member to be adjustably held to the tie by an anchor bolt, the direction of the slot being substantially perpendicular to the rail, and a washer member that is designed to be mounted snugly on the anchor bolt and ride next to the base member to hold the base member in one place when the washer member is tightened against it, both the base member and the washer member having complementary serrated surfaces that adjustably intermesh to help prevent the base member from sliding past the washer member when the washer member is tightened against it.

6. The assembly of claim 1 further comprising an elastomeric pad designed to underlie the base plate.

7. The assembly of claim 6 further comprising dielectric means for electrically isolating the base plate from the anchoring devices.

8. The assembly of claim 7 wherein the means for fastening the base member of the anchoring device to the rail tie include a slotted, vertical hole through the second end of the base member that enables the base member to be adjustably held to the tie by an anchor bolt, the direction of the slot being substantially perpendicular to the rail, and a washer member that is designed to be mounted snugly on the anchor bolt and ride next to the base member to hold the base member in one place when the washer member is tightened against it, both the base member and the washer member having complementary serrated surfaces that adjustably intermesh to help prevent the base member from sliding past the washer member when the washer member is tightened against it.

9. The assembly of claim 6 wherein the means for fastening the base member of the anchoring device to the rail tie include a slotted, vertical hole through the second end of the base member that enables the base member to be adjustably held to the tie by an anchor bolt, the direction of the slot being substantially perpendicular to the rail, and a washer member that is designed to be mounted snugly on the anchor bolt and ride next to the base member to hold the base member in one place when the washer member is tightened against it, both the base member and the washer member having complementary serrated surfaces that adjustably intermesh to help prevent the base member from sliding past the washer member when the washer member is tightened against it.

10. The assembly of claim 1 wherein the means for fastening the base member of the anchoring device to the rail tie include a slotted, vertical hole through the second end of the base member that enables the base member to be adjustably held to the tie by an anchor bolt, the direction of the slot being substantially perpendicular to the rail, and a washer member that is designed to be mounted snugly on the anchor bolt and ride next to the base member to hold the base member in one place when the washer member is tightened against it, both the base member and the washer member having complementary serrated surfaces that adjustably intermesh to help prevent the base member from sliding past the washer member when the washer member is tightened against it.

* * * * *